US005802794A

United States Patent [19]

Robson

[11] Patent Number: 5,802,794

[45] Date of Patent: Sep. 8, 1998

[54] CERAMIC FIBER SECURING DEVICE

[75] Inventor: Duncan T. Robson, Carlisle, Canada

[73] Assignee: Jayne Industries Inc., Stoney Creek, Canada

[21] Appl. No.: 851,284

[22] Filed: May 5, 1997

[51] Int. Cl.[6] ..... E04B 1/74

[52] U.S. Cl. ..... 52/407.4; 52/404.2; 411/392

[58] Field of Search ..... 52/506.02, 506.03, 52/506.04, 506.05, 407.4, 404.5, 404.2; 411/392, 438

[56] References Cited

U.S. PATENT DOCUMENTS 4,762,453 8/1988 De Caro ..... 411/392 X 4,917,554 4/1990 Brown ..... 411/438 X

*Primary Examiner*—Creighton Smith

*Attorney, Agent, or Firm*—Rogers & Milne

[57] ABSTRACT

A ceramic fiber securing device for securing at least one layer of ceramic fiber insulation to an existing ceramic fiber lining. The ceramic fiber securing device has a helical portion screwable about a first axis into the existing ceramic fiber lining. A generally straight portion extends from an outer end of the helical portion and has a second axis generally parallel to the first axis. Attachment means are provided for interacting with an outer retention member to attach the outer retention member to the generally straight portion.

16 Claims, 3 Drawing Sheets

CERAMIC FIBER SECURING DEVICE

FIELD OF THE INVENTION

This invention relates generally to ceramic fiber insulation securing devices and more particularly to devices for mounting a ceramic fiber refractory to an existing ceramic fiber refractory lining.

BACKGROUND OF THE INVENTION

One method of furnace construction comprises a metal shell to which is secured one or more layers of "refractory" (i.e. resistant to high temperature) insulation of the ceramic fiber type. The insulation may typically include several layers of "blanket type" insulation, modules made up of layers of insulation stacked generally perpendicular to a mounting face, ceramic fiber "board" or combinations of the foregoing as required by temperature and insulating parameters.

In use ceramic fiber insulation deteriorates as a result of exposure to temperature, abrasion and reaction with the furnace atmosphere. Typically the exposed or "hot" face of the ceramic fiber insulation will gradually deteriorate and shed. The hot face protects the underlying insulation by insulating it from high temperatures and direct exposure to the furnace atmosphere. Accordingly the insulation behind the hot face will remain reasonably sound until the adjacent hot face is shed. Eventually the shedding process will reduce the thickness of the lining to a point at which the insulating layer is too thin to adequately insulate the furnace shell. According to past practice, the furnace would be shut down at this stage for replacement of the entire lining.

Often the remaining lining would still be reasonably sound however its removal would nevertheless be required because of the securing system attaching the insulation to the furnace shell. The securing system generally comprises an array of "studs", often of stainless steel which are individually welded to the metal shell of the furnace. Layers of insulation are typically impaled over the studs, each layer being secured in place by metal securing washers or clips. The final layer of insulation is usually secured by a ceramic locking cup which is more heat resistant than metal washers or clips and therefore protects the outer end of the stud. The ceramic locking cup is generally filled with mortar during installation thereby preventing its removal for the installation of new layers of insulation. Hence the prior practice of removing all of the remaining insulation, removal of the studs, installation of new studs and installation of an entirely new lining.

The prior practice is wasteful because, as mentioned above, often the remaining insulation would not have deteriorated to such an extent as to require replacement, however its removal was nevertheless dictated by the requirement of direct access to the furnace shell to weld on new studs. Furthermore, removal of the remaining insulation is cumbersome and expensive because it is regarded as a hazardous substance and requires special handling.

It is an object of the present invention to provide a ceramic fiber securing device for securing a new layer or layers of ceramic fiber insulation to an existing ceramic fiber lining without requiring removal of the lining.

It is a further object of the present invention to provide a method for securing layers of ceramic fiber insulation to an existing ceramic fiber lining without requiring removal of the existing lining or direct access to the furnace shell.

SUMMARY OF THE INVENTION

A ceramic fiber securing device for securing at least one layer of ceramic fiber insulation to an existing ceramic fiber lining, said ceramic fiber securing device comprising:

a helical portion screwable about a first axis into said existing ceramic fiber lining;

a generally straight portion extending from an outer end of said helical portion and having a second axis generally parallel to said first axis; and, attachment means for interacting with an outer retention member to attach said outer retention member to said generally straight portion.

A method for installing a ceramic fiber insulating material over an existing ceramic fiber lining utilizing a plurality of ceramic fiber securing devices as described above and comprising the steps of:

i) screwing said helical portion of said ceramic fiber securing devices into said existing ceramic fiber lining leaving said generally straight portion extending generally perpendicularly from said existing lining;

ii) impaling at least one new layer of ceramic fiber insulation over said generally straight portion of said plurality of ceramic fiber securing devices; and iii) placing said outer retention member over said generally straight portion and attaching said outer retention member to said generally straight portion with said attachment means.

DESCRIPTION OF DRAWINGS

Preferred embodiments of the present invention are described in detail below with reference to the accompanying drawings in which.

DESCRIPTION OF PREFERRED EMBODIMENTS

Figure 3:
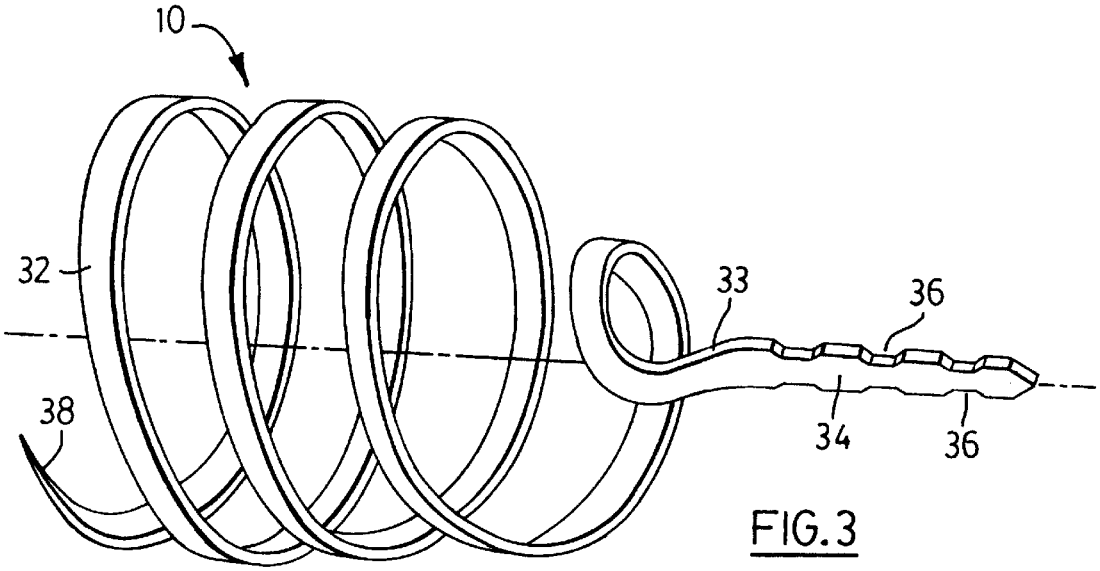
FIG. 3 is a perspective view of a ceramic fiber securing device according to the present invention.

A ceramic fiber securing device is generally illustrated by reference 10 in FIGS. 3 and 4.

Figure 1:
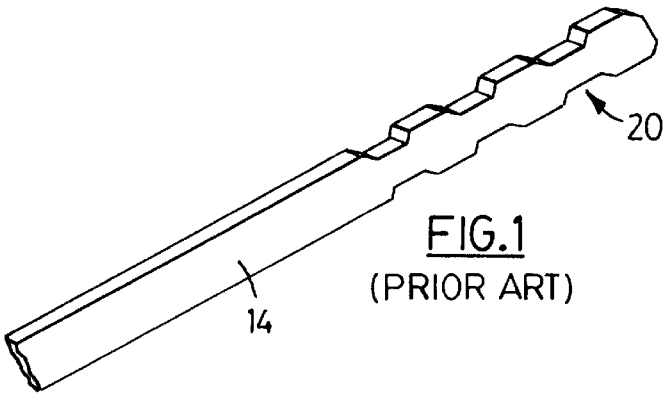
FIG.1 (PRIOR ART)
FIG. 1 is a perspective view of a typical prior art stud.
Figure 4:
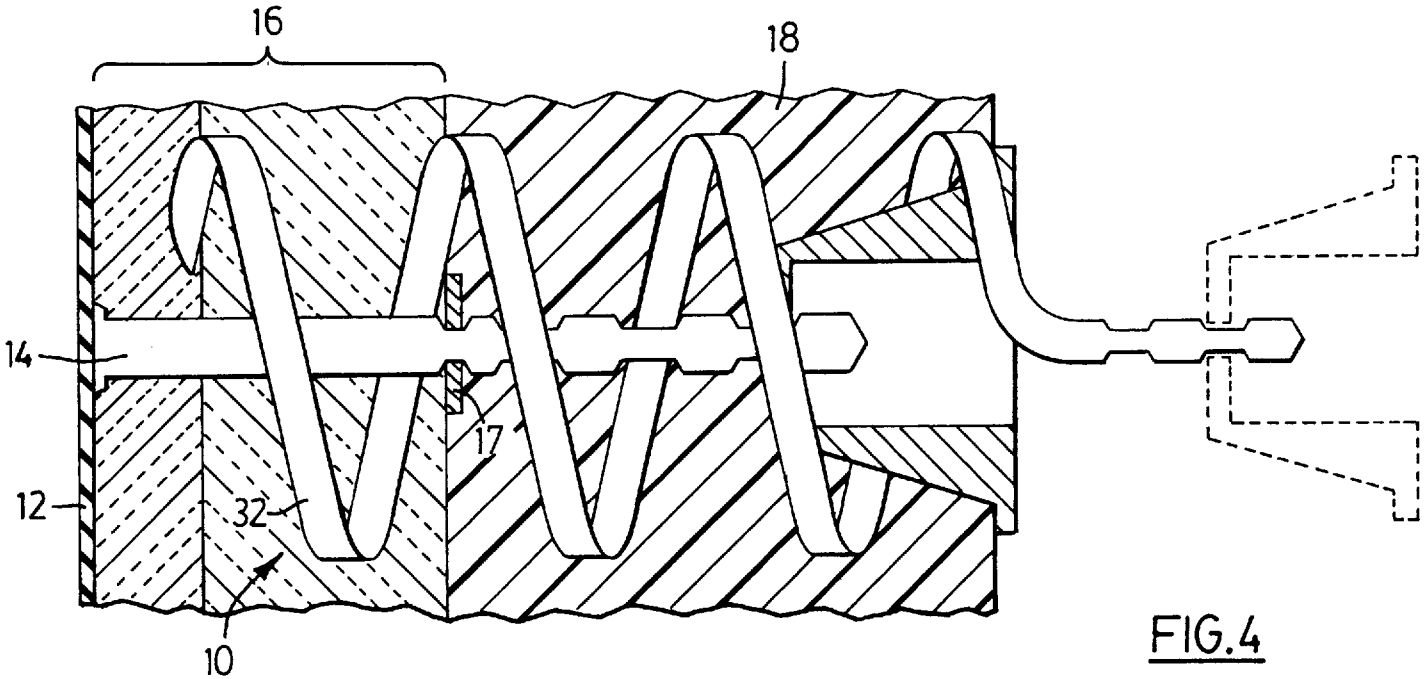
FIG. 4 is a partial sectional view illustrating a ceramic fiber securing device according to the present invention in use over a prior art stud/ceramic locking cup securing system.

FIG. 4 is a partial sectional view in which a steel furnace shell 12 is shown toward the left side of the drawing. A stud 14 is shown welded to the shell and extending to the right through two layers of back-up insulation 16 and one layer of hot face insulation 18. As shown in FIG. 1, the stud is of generally rectangular cross section with pairs of opposed securing notches 20 extending into the narrower faces of the stud adjacent one end of the stud.

Figure 2:
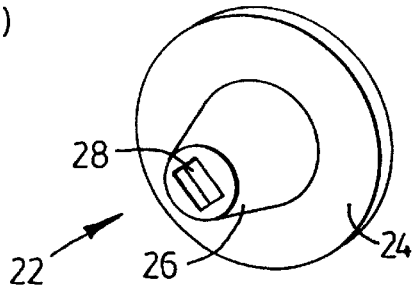
FIG.2 (PRIOR ART)
FIG. 2 is a perspective view of a typical prior art ceramic locking cup.

FIG. 2 illustrates a ceramic locking cup 22 which generally comprises a disc-shaped flange 24 from one face of which extends a generally conical projection 26. The conical projection 26 is hollow and has a rectangular opening 28 that enables it to be placed over a stud 14 and rotated 90 degrees to engage the securing notches thereby securing the locking cup 24 to the stud 14.

The back-up insulation 16 is initially secured in place with a securing clip or washer 17 having a rectangular opening that engages the securing notches 20 of the stud 14 in a manner similar to that of the rectangular opening 28 of the ceramic locking cup 22.

As shown in FIG. 4, the stud 14 would typically not extend all way to the outer face of the hot face insulation 18 but rather the conical projection 26 on the ceramic locking cup 22 would be inserted into a recess extending into the hot face insulation 18. Once in place a hollow portion 30 of the conical protection would typically be filled with mortar and/or covered with a ceramic cap (not shown). In this manner the outermost end of the stud is protected to some extent from the high temperatures inside of the furnace.

The ceramic fiber securing device 10 of the present invention is manufactured from a stainless steel strip of rectangular cross section, similar to that used for conventional studs 14. The ceramic fiber securing device 10 of the present invention has a spiral or "helical" portion 32 which is connected at an outer end 33 to a straight portion 34 having securing notches 36 much the same as in the conventional stud 14. The helical portion 32 is shown as having a sharpened end 38 distal the outer end 33 to assist insertion although this may not be entirely necessary.

In use the helical portion 32 of the ceramic fiber securing device 10 of the present invention is screwed (somewhat like a corkscrew) into an existing deteriorated ceramic fiber lining leaving only the straight portion 34 exposed. The helical portion 32 secures the anchor to the lining and relies on the interaction between the existing lining and conventional stud 14, and securing washer system to secure it to the furnace shell. The straight portion mimics the end of a conventional stud and in fact acts as a conventional stud over which the new hot face 40 lining may be impaled and secured using ceramic locking cups 22 as described above.

For lower temperature applications metal clips such as the securing dips 17 may be utilized in lieu of the ceramic locking cups 22.

The present invention is further illustrated by way of the example set out below.

EXAMPLE 1

Figure 5:
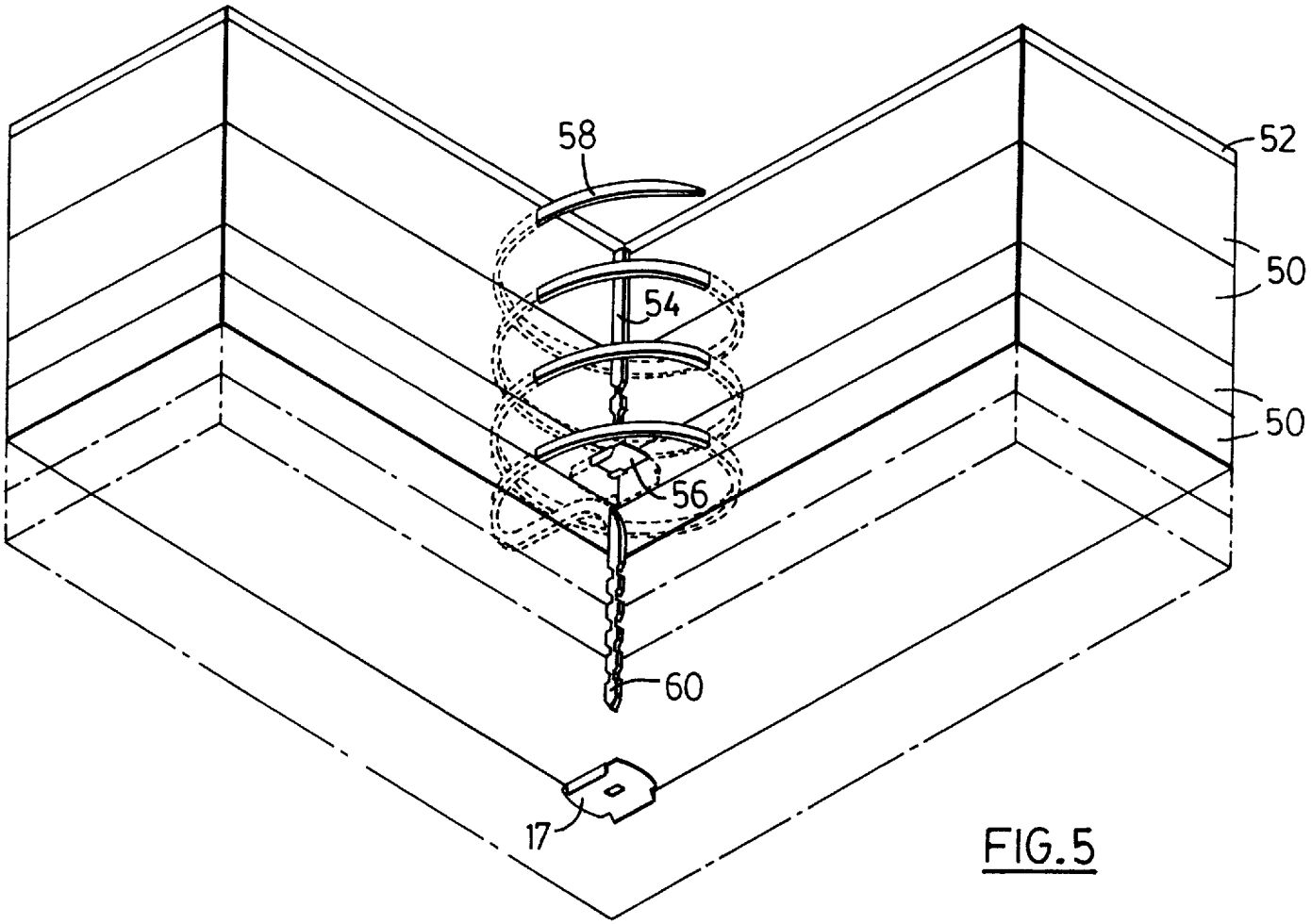
FIG. 5 is a partially cut away perspective view of a test installation described in Example 1 below.

Reference is made to FIG. 5 which illustrates an existing lining 50 mounted to a roof plate 52 of a [describe furnace or device to which lining secured] by means of a stud 54 and washer 56. The existing lining was made up of four layers of ceramic fiber blanket having a combined thickness on the order of 6 in.

A ceramic fiber securing device 58 according to the present invention was threaded through the existing fiber layers 50 leaving only a straight portion 60 protruding generally coaxial with the stud 54. The ceramic fiber securing device had the following approximate dimensions:

| | |
|---|---|
| diameter of helical portion | 4 in. (approx. 10 cm. ) |
| pitch of helical portion | 1 1/4 in. (approx. 3 cm.) |
| height of helical portion | 7 in. (approx. 13 cm.) |
| length of straight portion | 3 in. (approx. 7.5 cm.) |
| cross section area | 1/2 in. × 1/4 inc. (approx. 3 mm. × 6 mm.) |
| material [type of stainless] | |

After installation of the ceramic fiber securing device 58 a 10 lb. (approx. 4.5 kg) weight was suspended from the straight portion 60. No indication of undue strain or "pulling-out" of the ceramic fiber securing device was observed.

As interanchor spacing is generally from 12" to 18", and as a new lining will typically be on the order of 2 in. thick with a density of about 8 lb. per cubic foot, the amount of force typically carried by each ceramic fiber securing device will generally be considerably less than 10 lb.

In the present example, two layers of 1 in. thick ceramic fiber blanket were impaled over the ceramic fiber securing devices 58 with about the same effort as would be required to install similar insulation over a conventional stud.

The above description is intended in an illustrative rather than a restrictive sense. Variations to the invention as described above may be apparent to those skilled in the relevant art without departing from the spirit and scope of the present invention as defined by the claims set out below. For example the length, pitch and diameter of the helical portion may be selected to suit particular installation requirements. Additionally it is not entirely necessary to have the straight portion coaxial with the helical portion even though such an arrangement may be desirable.

I claim:

1. A ceramic fiber securing device for securing at least one layer of ceramic fiber insulation to an existing ceramic fiber lining, said ceramic fiber securing device comprising:

a helical portion screwable about a first axis into said existing ceramic fiber lining;

a generally straight portion integral with and extending from an outer end of said helical portion and having a second axis generally parallel to said first axis; and attachment means for interacting with an outer retention member to attach said outer retention member to said generally straight portion.

2. A ceramic fiber securing device as claimed in claim 1 wherein said helical portion has a sharpened inner end distal said outer end for facilitating insertion of said helical portion into said existing lining as said helical portion is screwed into said existing lining during installation.

3. A ceramic fiber securing device as claimed in claim 1 wherein said attachment means are notches extending into opposite sides of said generally straight portion and for engaging a ceramic locking cup.

4. A ceramic fiber securing device as claimed in claim 1 wherein said first axis is generally coaxial with said second axis.

5. A ceramic fiber securing device as claimed in claim 2 wherein said attachment means are notches extending into opposite sides of said generally straight portion for engaging a ceramic locking cup.

6. A ceramic fiber securing device as claimed in claim 4 wherein said attachment means are notches extending into opposite sides of said generally straight portion for engaging a ceramic locking cup.

7. A ceramic fiber securing device as claimed in claim 2 wherein said first axis is generally coaxial with said second axis.

8. A ceramic fiber securing device as claimed in claim 7 wherein said attachment means are notches extending into opposite sides of said generally straight portion for engaging a ceramic locking cup.

9. A method for installing a ceramic fiber insulating material over an existing ceramic fiber lining utilizing a plurality of ceramic fiber securing devices as claimed in claim 1 and comprising the steps of:

i) screwing said helical portion of said ceramic fiber securing device into said existing ceramic fiber lining leaving said generally straight portion extending generally perpendicularly from said existing lining;

ii) impaling at least one new layer of ceramic fiber insulation over said generally straight portion of said plurality of ceramic fiber securing devices; and attaching an outer retention member to said generally straight portion.

10. A method for installing a ceramic fiber insulating material over an existing ceramic fiber lining utilizing a plurality of ceramic fiber securing devices as claimed in claim 2 and comprising the steps of:

i) screwing said helical portion of said ceramic fiber securing device into said existing ceramic fiber lining leaving said generally straight portion extending generally perpendicularly from said existing lining;

ii) impaling at least one new layer of ceramic fiber insulation over said generally straight portion of said plurality of ceramic fiber securing devices; and attaching an outer retention member to said generally straight portion.

11. A method for installing a ceramic fiber insulating material over an existing ceramic fiber lining utilizing a plurality of ceramic fiber securing devices as claimed in claim 3 and comprising the steps of:

i) screwing said helical portion of said ceramic fiber securing device into said existing ceramic fiber lining leaving said generally straight portion extending generally perpendicularly from said existing lining;

ii) impaling at least one new layer of ceramic fiber insulation over said generally straight portion of said plurality of ceramic fiber securing devices; and attaching a ceramic locking cup to said generally straight portion.

12. A method for installing a ceramic fiber insulating material over an existing ceramic fiber lining utilizing a plurality of ceramic fiber securing devices as claimed in claim 4 and comprising the steps of:

i) screwing said helical portion of said ceramic fiber securing device into said existing ceramic fiber lining leaving said generally straight portion extending generally perpendicularly from said existing lining;

ii) impaling at least one new layer of ceramic fiber insulation over said generally straight portion of said plurality of ceramic fiber securing devices; and attaching an outer retention member to said generally straight portion.

13. A method for installing a ceramic fiber insulating material over an existing ceramic fiber lining utilizing a plurality of ceramic fiber securing devices as claimed in claim 5 and comprising the steps of:

i) screwing said helical portion of said ceramic fiber securing device into said existing ceramic fiber lining leaving said generally straight portion extending generally perpendicularly from said existing lining;

ii) impaling at least one new layer of ceramic fiber insulation over said generally straight portion of said plurality of ceramic fiber securing devices; and attaching a ceramic locking cup to said generally straight portion.

14. A method for installing a ceramic fiber insulating material over an existing ceramic fiber lining utilizing a plurality of ceramic fiber securing devices as claimed in claim 6 and comprising the steps of:

i) screwing said helical portion of said ceramic fiber securing device into said existing ceramic fiber lining leaving said generally straight portion extending generally perpendicularly from said existing lining;

ii) impaling at least one new layer of ceramic fiber insulation over said generally straight portion of said plurality of ceramic fiber securing devices; and attaching a ceramic locking cup to said generally straight portion.

15. A method for installing a ceramic fiber insulating material over an existing ceramic fiber lining utilizing a plurality of ceramic fiber securing devices as claimed in claim 7 and comprising the steps of:

i) screwing said helical portion of said ceramic fiber securing device into said existing ceramic fiber lining leaving said generally straight portion extending generally perpendicularly from said existing lining;

ii) impaling at least one new layer of ceramic fiber insulation over said generally straight portion of said plurality of ceramic fiber securing devices; and attaching an outer retention member to said generally straight portion.

16. A method for installing a ceramic fiber insulating material over an existing ceramic fiber lining utilizing a plurality of ceramic fiber securing devices as claimed in claim 8 and comprising the steps of:

i) screwing said helical portion of said ceramic fiber securing device into said existing ceramic fiber lining leaving said generally straight portion extending generally perpendicularly from said existing lining;

ii) impaling at least one new layer of ceramic fiber insulation over said generally straight portion of said plurality of ceramic fiber securing devices; and attaching an outer retention member to said generally straight portion.

* * * * *